US008777072B2

(12) United States Patent
Christie

(10) Patent No.: US 8,777,072 B2
(45) Date of Patent: Jul. 15, 2014

(54) UMBRELLA ENGAGE WITH CARRIER BAG

(71) Applicant: Joseph L. Christie, ChannelView, TX (US)

(72) Inventor: Joseph L. Christie, ChannelView, TX (US)

( * ) Notice: Subject to any disclaimer, the term of this patent is extended or adjusted under 35 U.S.C. 154(b) by 51 days.

(21) Appl. No.: 13/710,779

(22) Filed: Dec. 11, 2012

(65) Prior Publication Data

US 2014/0158725 A1 Jun. 12, 2014

(51) Int. Cl.
*A45B 11/02* (2006.01)

(52) U.S. Cl.
CPC ..... *A45B 11/02* (2013.01)
USPC ..... 224/186

(58) Field of Classification Search
CPC ..... A45B 11/00; A45B 11/02; A45C 13/40
USPC ..... 224/186–190, 251, 915
See application file for complete search history.

(56) References Cited

U.S. PATENT DOCUMENTS

| | | | | |
|---|---|---|---|---|
| 1,755,209 | A * | 4/1930 | Danner | 224/186 |
| 2,541,614 | A * | 2/1951 | Rosenberger | 224/188 |
| 3,730,197 | A * | 5/1973 | Lunney | 135/16 |
| 4,537,339 | A * | 8/1985 | Pearson | 224/188 |
| 6,308,722 | B1 * | 10/2001 | Christie | 135/16 |
| 6,533,237 | B1 * | 3/2003 | Matusek | 248/514 |

* cited by examiner

*Primary Examiner* — Adam Waggenspack
(74) *Attorney, Agent, or Firm* — Delphine James

(57) ABSTRACT

The present invention comprises a carrier bag with an anchoring structure. The anchoring structure is inserted into the carrier bag and allows an umbrella to be attached to the anchoring structure. The umbrella has a collapsible canopy and can be stored in a storage compartment on the carrier bag.

9 Claims, 8 Drawing Sheets

UMBRELLA ENGAGE WITH CARRIER BAG

BACKGROUND OF THE INVENTION

1. Field of the Invention

This invention relates to an umbrella, and more particularly concerns an umbrella which can be supported by a carrier bag including a brief case, post office mail bag and other suitable bag worn by the user.

2. Description of the Prior Art

Umbrellas intended for hand-held use are generally comprised of a collapsible canopy, an elongated shaft that is usually telescopically extendable, and a holding handle disposed at the lower extremity of the shaft. Such umbrellas have long been used by persons desiring to shield themselves from the sun and rain. It is well established that, from a health standpoint, it is desirable to minimize exposure to direct sunlight.

Conventionally, umbrellas are hand carried by the person using the umbrella. Carrying an umbrella, however does not allow the free use of a person's hands to carry packages or the like, or perform other functions. It is therefore desirable to provide an improved umbrella that will allow a person using the umbrella to use their hands without being encumbered by the umbrella.

While umbrellas have heretofore been strapped to the back of a person, they are difficult to attach and the harnesses are clumsy. Further, such harnesses must be detached if the umbrella is to be hand-held, as is conventional. It is therefore desirable to provide an umbrella which can be worn, if desired, but which includes structure which allows the umbrella to be worn or hand-held, as desired, while still being convenient to use and conveniently stored.

Examples of such back-mounted umbrellas are disclosed in U.S. Pat. Nos. D330,455; D345,856; D361,654; 3,892,251 and 4,188,965. In general, such back-mounted umbrellas involve a harness which either secures an umbrella of usual construction having a bottom handle, or secures a specially constructed umbrella having a straight shaft that removably inserts into a holding structure associated with the harness.

A common shortcoming of prior back-mounted umbrellas is that the umbrella tends to rotate within the holding structure, particularly in strong winds. Also, tilting movements in both the path of the person's walking movement and in the lateral or transverse direction are difficult to control. When a specialized harness is employed, it is difficult to emplace and is restrictive, and serves no other useful purpose.

It is accordingly an object of the present invention to provide an umbrella and frame support combination wherein the frame provides support for the umbrella.

It is a further object of this invention to provide the combination of the foregoing object wherein the umbrella is easily attached to and removed from a receiver attached to the frame support.

It is another object of the present invention to provide the combination of the aforesaid nature wherein the umbrella, in its deployed, open state is stabilized with respect to rotative and tilting movements.

It is yet another object of this invention to provide the combination of the aforesaid nature wherein said carrier bag contains means for securing said umbrella in its collapsed, storage state.

It is a still further object of the present invention to provide the combination of the aforesaid nature wherein the separate functionality of umbrella and bag remains unimpaired.

These objects and other objects and advantages of the invention will be apparent from the following description.

SUMMARY OF THE INVENTION

The above and other beneficial objects and advantages are accomplished in accordance with the present invention by an umbrella and carrier bag combination comprising:

a) an umbrella comprising a collapsible canopy and a straight center shaft interactive with said canopy and extending to a lower handle having a fastener releasably engaged within the tubular receiver mounted within an anchoring structure;

b) a carrier bag having a storage compartment bounded in part by a bottom panel with adjoining sidewalls extending upward to an enclosure opening with attached shoulder straps, and c) The embodiment further comprises an anchoring structure which is removable from the storage compartment of the carrier bag.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
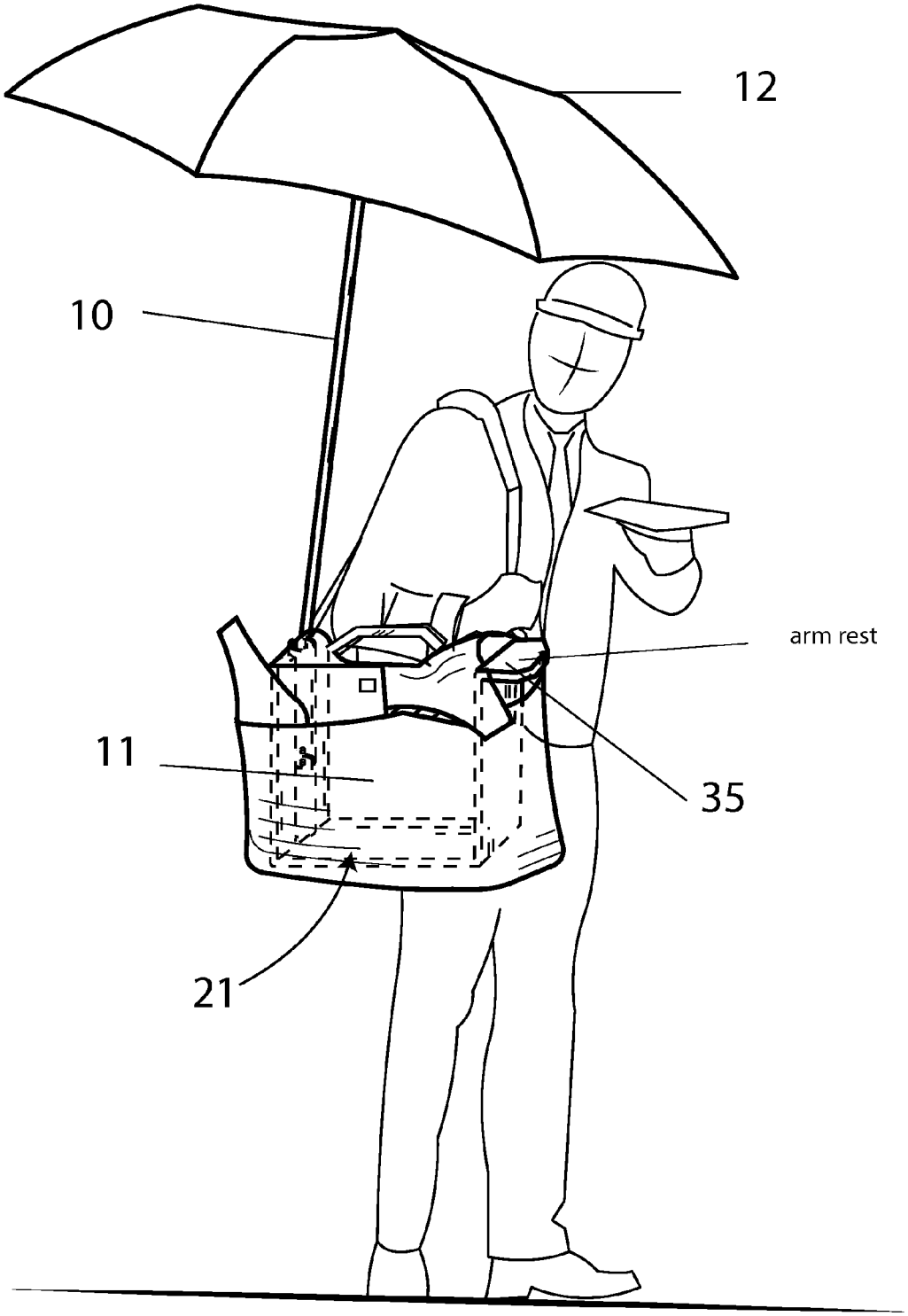
FIG. 1 is a front view of the present invention in use.
Figure 1A:
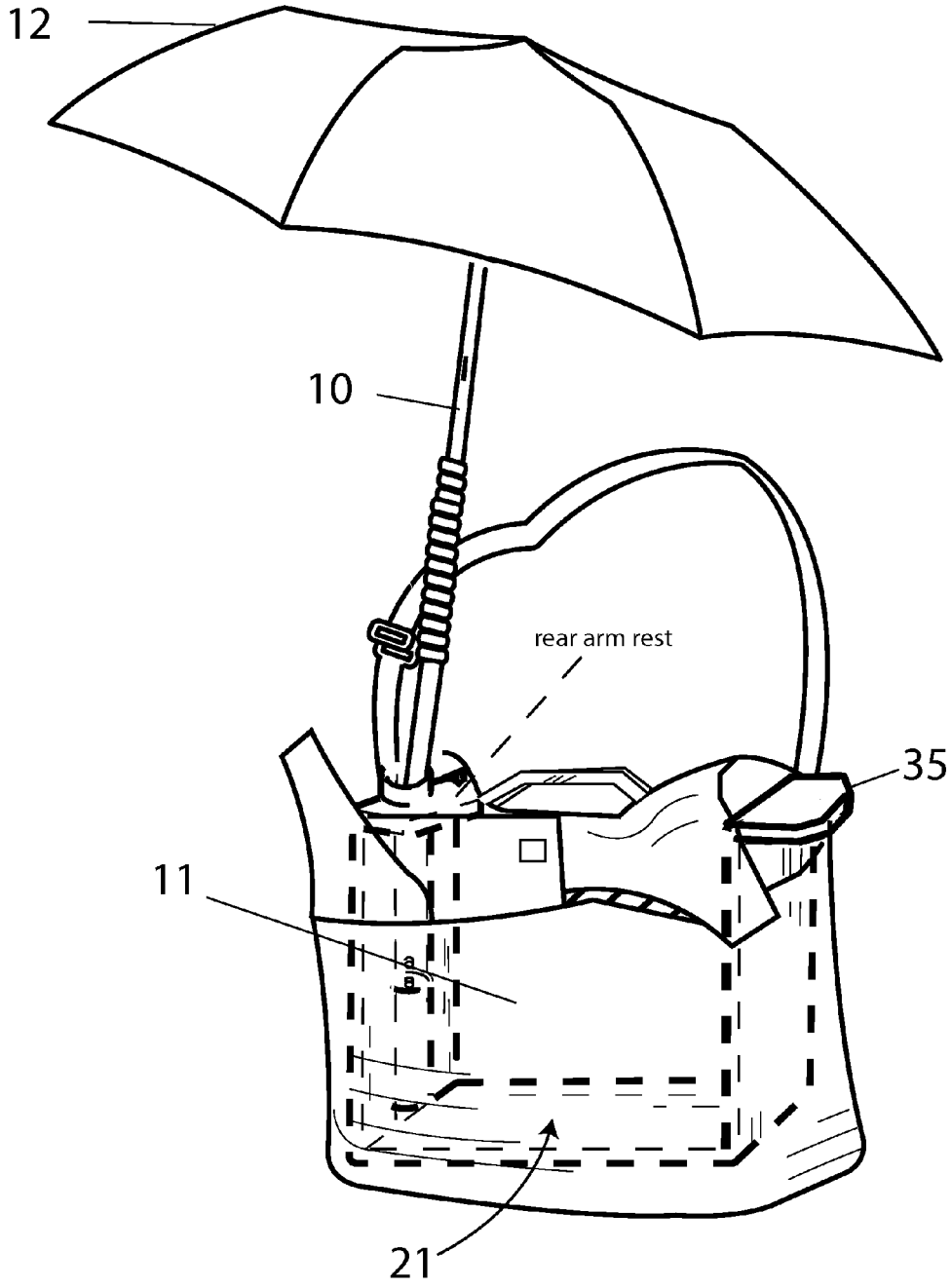
FIG. 1*a* is an exploded view of the bag.
Figure 1B:
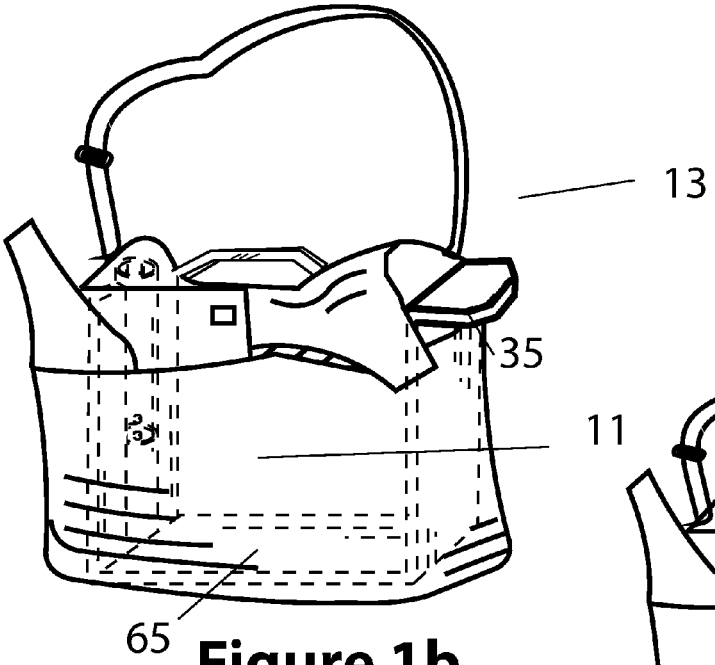
FIG. 1*b* is a front view of the anchoring system in the bag.
Figure 1C:
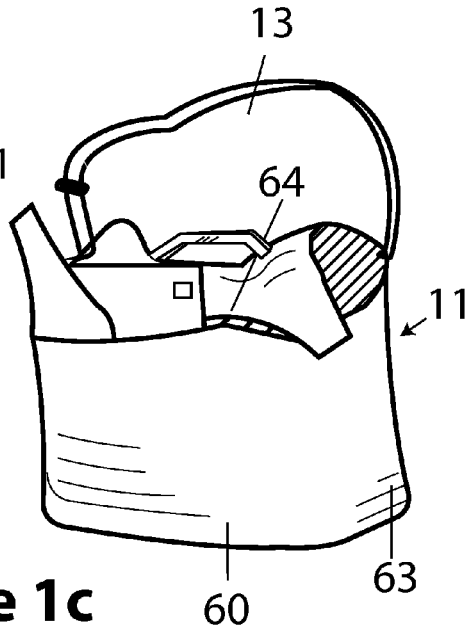
FIG. 1*c* is a front view of the bag.
Figure 1D:
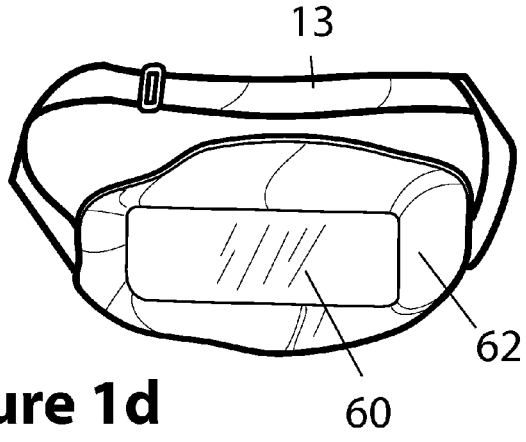
FIG. 1*d* is a top planar view of the bag.

Referring now to FIGS. 1-5*e*, an embodiment of the umbrella and frame support combination (10) of the present invention is shown comprised of frame structure (10) and umbrella (12). As shown in FIGS. 1 and 1*a* frame structure (10) is inserted into carrier bag (11). Frame structure (10) comprises a bottom panel (65) having a length and width equivalent to bottom panel (60) of carrier bag (11). On opposing front and back side edge, a front panel and back panel extend linearly upward to the height of the carrier bag (11). In use, the underside of frame structure (10) is inserted through the opening (64) of bag (11) and abuts bottom panel (60) as shown in FIG. 1*b*. Then, the external surface of the front and opposing back panel abuts the internal surface of the front and back panel of the carrier bag (11).

Referring FIG. 2 and FIGS. 5*a*-5*e*, umbrella holding mechanism in the form of anchoring structure (21) is shown. Anchoring structure 21 is comprised of a vertically disposed tubular receiver 22 having an open upper extremity 23 and a lower portion (41). Within the cavity of receiver 22 is a male fastener 52 disposed above the lower portion (41). The lower portion 41 of said receiver is preferably flattened so as to minimize space occupied within the carrier bag 11. In the preferred embodiment, to stabilize the umbrella (12), the anchor structure 21 is incorporated into the back panel ( ) as shown. In alternative embodiments, the anchor structure can be incorporated into the front panel ( ).

Figure 2:
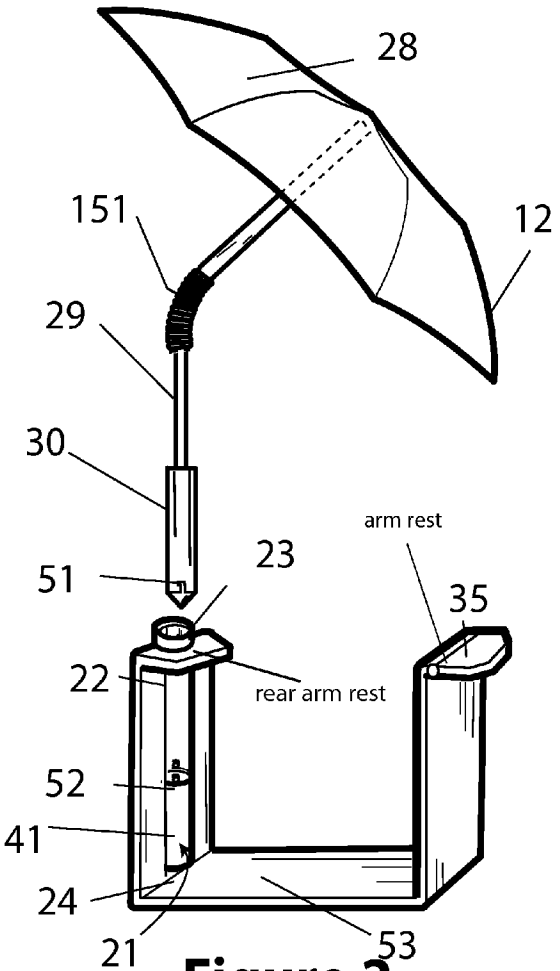
FIG. 2 is a side view of the frame support.
Figure 4:
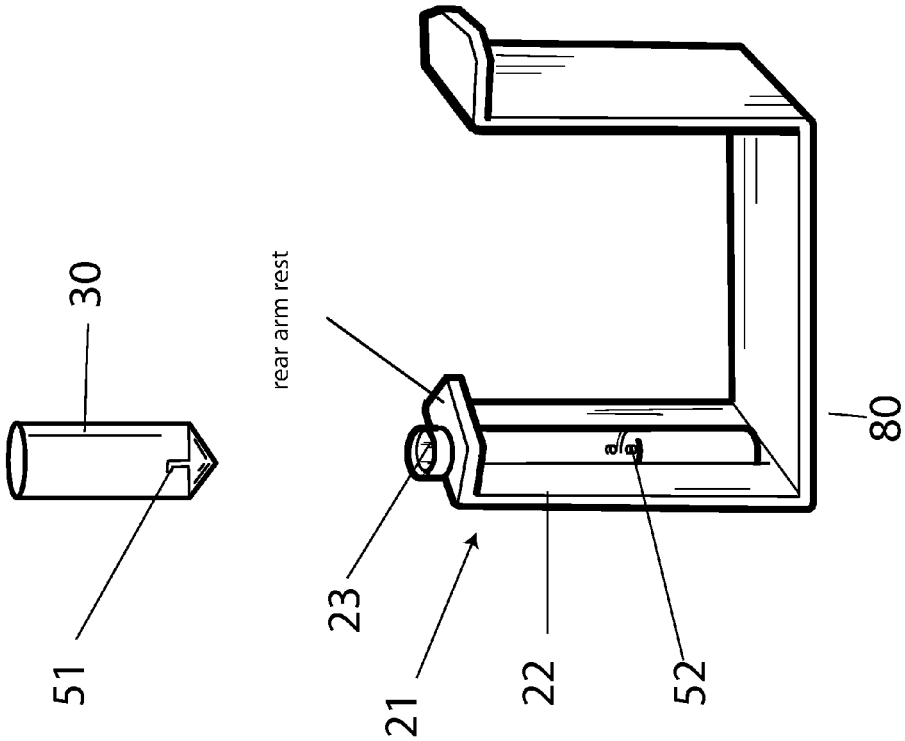
FIG. 4 is a side view of the anchor tube and frame support.

As shown in FIG. 2, the anchoring structure 21 is vertically mounted within the front or back panel of frame structure (10). This allows the anchoring structure 21 to be placed in a conventional carrier bag as depicted in FIG. 1. Anchoring structure 21 may be fabricated of lightweight metal such as aluminum, or may be fabricated of plastic, in which case it may be a monolithic structure produced by way of a molding operation.

Figure 3:
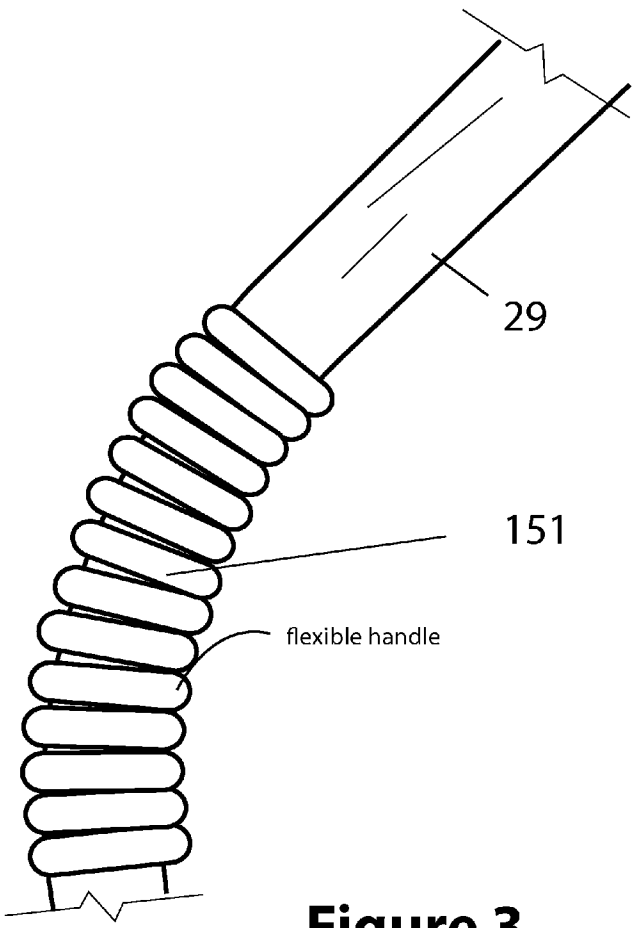
FIG. 3 is a cutaway view of the flexible handle.

As shown is FIGS. 2-5, umbrella 12 is comprised of collapsible canopy 28 and a straight center shaft 29 interactive in conventional manner with said canopy. Shaft 29, preferably of telescopically extendable tubular construction, extends to a lower terminal handle 30 equipped with male fastener 51 that inter locks into the female fastener 52 located within the cavity of receiver 22. Alternatively, handle 30 can be as shown in FIG. 3 equipped with a flexible center 151 that allows shaft (29) to be adjusted in various directions.

As shown in FIG. 5*a*-5*e*, locking mechanism comprises female fastener 52 and male fastener 51. In one embodiment, female fastener 52 can be fabricated as a recessed portion incorporated within handle 30 or removable sleeve 130. Mating male fastener 51 can be fabricated as a locking pin or a spline with receiving slots which securely engaged within recessed portion. Alternatively, locking mechanism can comprise an internal padding within the cavity of receiver (22) which securely engages with handle 30 of the umbrella shaft 29 wherein umbrella 12 is held in place as shown in FIG. 6-6*b*. Locking mechanism can be manufactured by way of other means.

A push-button control 34 on shaft 29 causes the canopy 55 of the umbrella to move vertically upward or downward. The umbrella, in its collapsed storage state may have a length of between about 10 and 14 inches.

Figure 5:
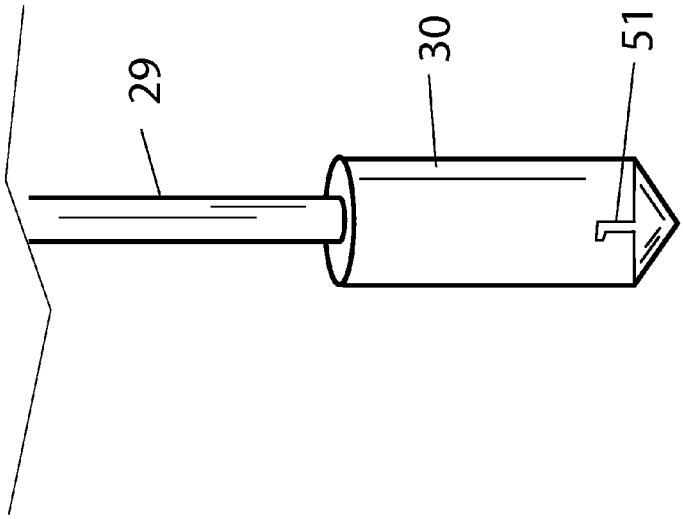
FIG. 5 is a cutaway view of the bottom of the umbrella.
Figures 5A, 5B, 5C, 5D, 5E:
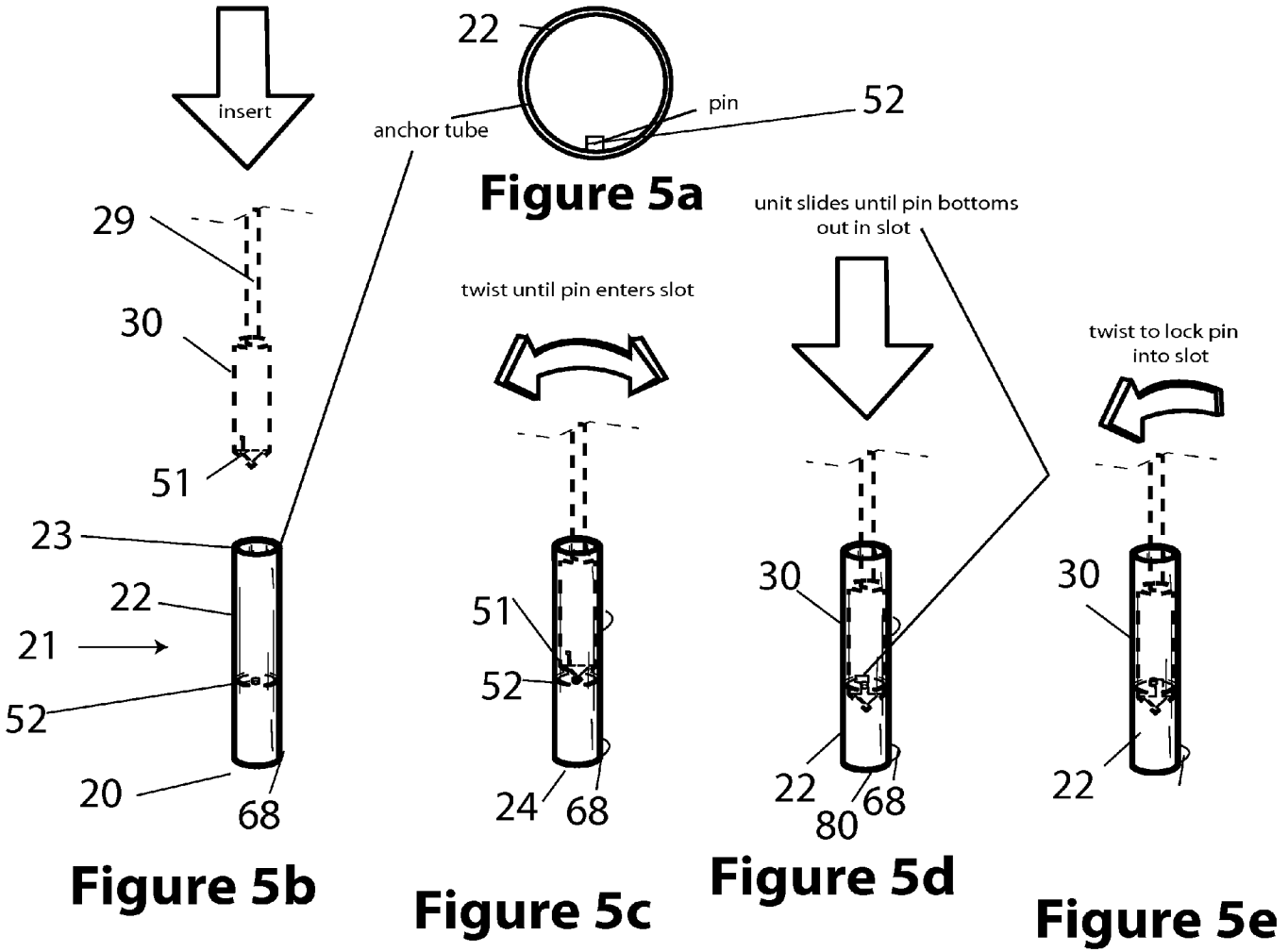
FIG. 5*a* is a top view of the anchor tube and pin.
FIG. 5*b* is a front view of the insertion of umbrella into anchor tube.
FIG. 5*c* is a front view of the umbrella in the anchor tube.
FIG. 5*d* is a front view of the locking sequence of the present invention.
FIG. 5*e* is a front view of the locking mechanism of the present invention.
Figure 6B:
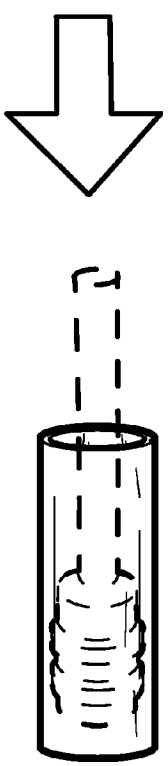
FIG. 6*b* is a cutaway view of the alternative umbrella handle inserted into tubular receiver.
Figure 6A:
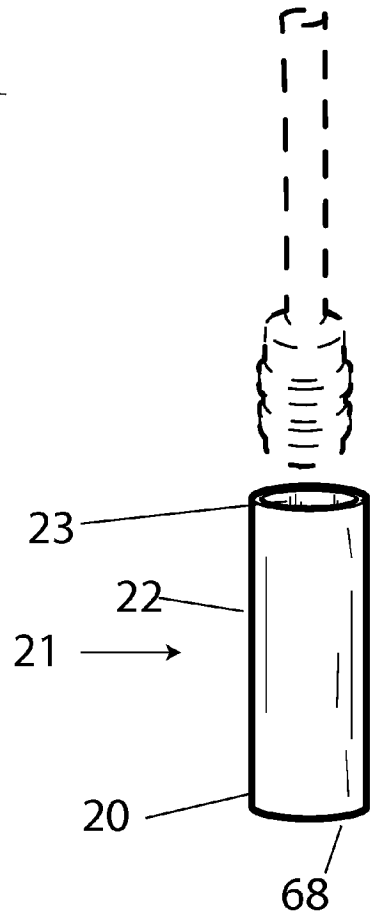
FIG. 6*a* is a cutaway view of the alternative umbrella handle being inserted into tubular receiver.
Figure 6:
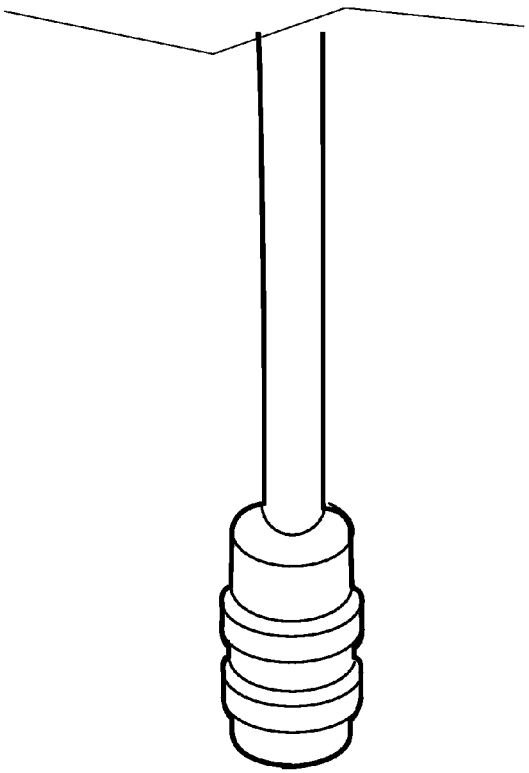
FIG. 6 is a cutaway view of an alternative umbrella handle.

When shaft 29 is inserted into receiver 22, the user pushes downward as shown in FIGS. 5*a*-5*b*, the umbrella is sufficiently secure so as to resist rotative movement about the shaft axis, and to resist tilting movement in any direction away from vertically. A hand grip 38 is preferably associated with shaft 29 adjacent said terminal extremity 30. Said hand grip facilitates the use of the umbrella in a conventional hand-held manner detached from anchoring structure (21).

Figure 7A:
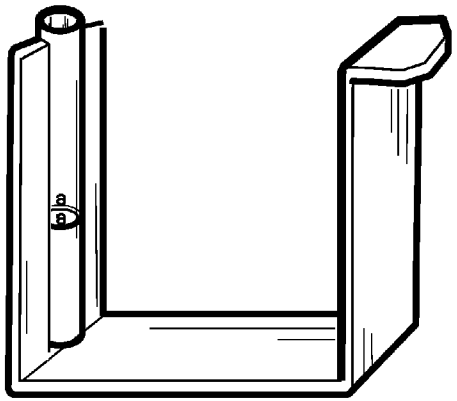
FIG. 7*a* is a cut away view of the carrier frame with a hinged arm rest.
Figure 7B:
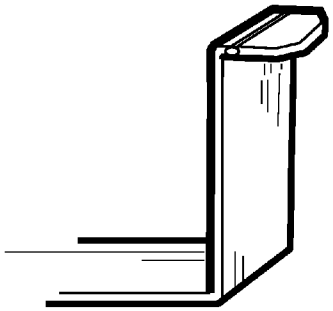
FIG. 7*b* is a cutaway side view of the arm rest extended.
Figure 7C:
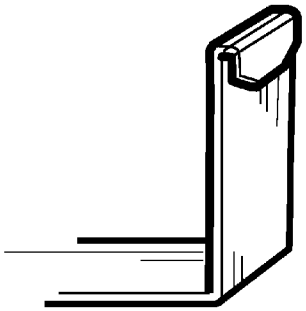
FIG. 7*c* is a side view of the arm rest folded downward.
Figure 8A:
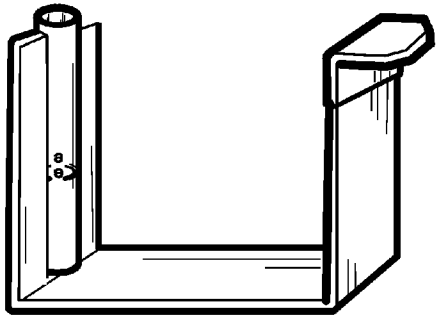
FIG. 8*a* is a cutaway side view of the arm rest inserted on the carrier frame.

In alternative embodiments, frame structure (11) can be configured with an arm rest (200). In FIG. 7A-7C arm rest (200) can be hingedly connected to the upper edge (201) of the front panel or alternatively the back panel. Arm rest (201) further comprises a flat platform having a polygonal shape which is perpendicularly and hingedly adjoined to the upper edge (201). As shown in FIG. 8A, arm rest (201) has a channel formed within short panel (205) that is configured to be slidably mounted upon the upper edge (201) of the front panel or back panel When not in use arm rest (200) can be folded downward as shown in FIG. 7C.

Figure 8B:
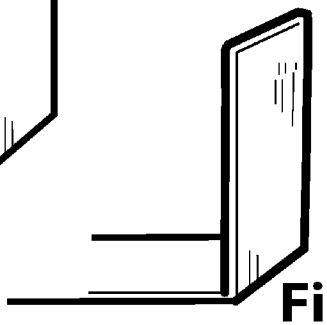
FIG. 8*b* is a cutaway side view of the with the arm rest removed.
Figure 8C:
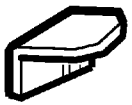
FIG. 8*c* is a cutaway view of the removed armrest.

In alternative embodiments, frame structure (11) can be configured with an arm rest (200). In FIG. 8A-8C arm rest (202) can be removeably connected to the upper edge (201) of the front panel or alternatively the back panel. Arm rest (201) further comprises a flat platform having a polygonal shape which is perpendicularly adjoined to a short panel (205) that extend linearly downward a short distance. As shown in FIG. 8A, arm rest (201) has a channel formed within short panel (205) that is configured to be slidably mounted upon the upper edge (201) of the front panel or back panel. When not in use arm rest (201) can be removed as shown in FIGS. 8B and 8C.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

What is claimed is:

1. An anchoring device used in combination with a carrier bag and an umbrella, the device comprising:

the carrier bag having a storage compartment defined by a bottom panel, a front panel, a back panel and opposing side panels with an upper opening;

a frame structure comprising a bottom panel with an adjoined front panel and an opposing back panel that extends upward to a pre-defined height equivalent to the front panel of the carrier bag and the back panel of the carrier bag;

a canopy fixably mounted upon a top end of an umbrella shaft that extends downward to a handle with a locking mechanism operationally associated therewith;

a stabilizer unit comprising a tubular receiver mounted within the front or back panel of the frame structure;

the tubular receiver defined by an upper portion formed upon and disposed above a lower portion;

the upper portion of the tubular receiver having a cavity extending downward to above the lower portion which extends downward to a predetermined length an attaching element mounted within the cavity above the lower portion;

the locking mechanism securely engaging with the attaching element as the handle of the umbrella shaft is inserted into the cavity of the tubular receiver wherein the umbrella is held in place; and a back side of the bottom panel, a back side of the front panel and a back side of the front panel of the frame structure abutting the bottom panel of the carrier bag when the frame structure is inserted through the upper opening.

2. The device of claim 1, wherein the locking mechanism allows the tubular receiver to slidably receive and secure the handle therein.

3. The device of claim 1 wherein the umbrella shaft has a flexible portion which allows the umbrella to be moved in various directions.

4. The device of claim 1 further comprising:

an arm rest having a platform with a flat surface defined by a lower edge and a front edge; and the lower edge being hingedly connected to the upper edge of the front or back panel.

5. The device of claim 1 further comprising:

an arm rest having a platform defined by a lower edge and a front edge; and the lower edge being adjoined to a second panel that extends downwardly wherein the arm rest has an L shape;

the second panel cooperatively connected to the upper edge of the front or back panel.

6. The device of claim 1 wherein the lower portion is flattened and extends linearly downward from the upper portion to a predetermined length.

7. The device of claim 1 wherein the locking mechanism is removably mounted upon the handle.

8. The device of claim 2 wherein the carrier bag further comprises:

the forward surface being detachable allowing the compartment to be detachable wherein a facing panel is formed;

a fastener mechanism attached to a lower end of the facing panel wherein the compartment can be secured thereto.

9. A method utilizing an anchoring device using in combination an umbrella and carrier bag, the method comprising:

providing the device in claim 1;

opening the storage compartment of the carrier bag;

placing the frame structure within the storage compartment with the tubular receiver extending upward through the opening of the storage compartment;

placing the bottom panel of the frame abutting the bottom panel of the storage compartment;

placing the umbrella shaft into the cavity of the tubular receiver;

securely engaging the locking mechanism with the attaching element wherein the umbrella is held in place; and closing the storage compartment wherein the stabilizing unit is held in place within the storage compartment.

* * * * *